US008602216B1

(12) United States Patent
Lin

(10) Patent No.: US 8,602,216 B1
(45) Date of Patent: Dec. 10, 2013

(54) PACKING BOX STRUCTURE FOR CELL PHONE PROTECTION CASE

(71) Applicant: Chia Hao Lin, New Taipei (TW)

(72) Inventor: Chia Hao Lin, New Taipei (TW)

( * ) Notice: Subject to any disclaimer, the term of this patent is extended or adjusted under 35 U.S.C. 154(b) by 0 days.

(21) Appl. No.: 13/670,021

(22) Filed: Nov. 6, 2012

(30) Foreign Application Priority Data

Jun. 22, 2012 (TW) ..... 101212031 U

(51) Int. Cl.
*B65D 73/00* (2006.01)

(52) U.S. Cl.
USPC ..... 206/464; 206/467; 206/471

(58) Field of Classification Search
USPC ..... 206/320, 461–471, 806; 229/87.01, 229/87.06
See application file for complete search history.

(56) References Cited

U.S. PATENT DOCUMENTS

| | | | | | |
|---|---|---|---|---|---|
| 239,225 | A * | 3/1881 | Claussen | 220/4.24 |
| 2,681,142 | A * | 6/1954 | Cohen | 206/205 |
| 4,033,452 | A * | 7/1977 | Therrien | 206/0.83 |
| 4,699,291 | A * | 10/1987 | Prais et al. | 206/467 |
| 4,848,541 | A * | 7/1989 | Paliotta et al. | 206/471 |
| 5,129,527 | A * | 7/1992 | Lataix | 206/461 |
| 5,813,546 | A * | 9/1998 | Wilson et al. | 206/461 |
| 6,484,875 | B1 * | 11/2002 | Brainerd et al. | 206/461 |
| 7,350,645 | B1 * | 4/2008 | Sills | 206/461 |

* cited by examiner

*Primary Examiner* — Luan K Bui
(74) *Attorney, Agent, or Firm* — Muncy, Giessler, Olds & Lowe, PLLC

(57) ABSTRACT

A packing box structure for a cell phone protection case includes a main body, a pair of transparent lids and a seal rib. The main body has a pair of grooves and a pair of positioning portions at two sides thereof for engagement of a pair of cell phone protection cases. The pair of transparent lids is adapted to cover the two sides of the main body. The seal rib is adapted to clip the pair of transparent lids, so that the transparent lids and the main body are sealed to prevent dust from entering the packing box. The packing box can be assembled and disassembled repeatedly for a consumer to check the cell phone protection cases. The packing box has a better seal effect and can be used conveniently.

2 Claims, 3 Drawing Sheets

PACKING BOX STRUCTURE FOR CELL PHONE PROTECTION CASE

BACKGROUND OF THE INVENTION

1. Field of the Invention

The present invention relates to a packing box structure for a cell phone protection case, and more particularly to a packing box structure which has a seal effect to prevent dust from entering the packing box and can be assembled and disassembled repeatedly.

2. Description of the Prior Art

A conventional packing box structure for a cell phone protection case comprises a hard transparent film in a soft transparent plastic bag and a board to close the hard transparent film. A staple is used to staple the periphery of the packing box. This structure has some shortcomings. Dust may enter the cell phone protection case. The soft transparent plastic bag is unable to prevent the cell phone protection case from deformation caused by an external object. The hard transparent film and the board are connected by a staple. This connection way doesn't have a seal effect so dust may dirty the cell phone protection case. When a consumer wants to check the cell phone protection case, it is necessary to disassemble the packing box and then to staple the packing box again. It is inconvenient to use the packing box. The packing box has holes caused by the use of staples when be assembled again. The consumer may misunderstand the cell phone protection case is not a new one. Accordingly, the inventor of the present invention has devoted himself based on his many years of practical experiences to solve this problem.

SUMMARY OF THE INVENTION

The primary object of the present invention is to provide a packing box structure for a cell phone protection case. The packing box structure provides a better seal effect and can be used conveniently. The packing box structure comprises a main body, a pair of transparent lids and a seal rib. The main body has a pair of grooves and a pair of positioning portions at two sides thereof for engagement of a pair of cell phone protection cases. The pair of transparent lids is adapted to cover the two sides of the main body. The seal rib is adapted to clip the pair of transparent lids, so that the transparent lids and the main body are assembled and secured to prevent dust from entering the packing box. The packing box can be assembled and disassembled repeatedly for a consumer to check the cell phone protection cases.

DETAILED DESCRIPTION OF THE PREFERRED EMBODIMENTS

Embodiments of the present invention will now be described, by way of example only, with reference to the accompanying drawings.

Figure 1:
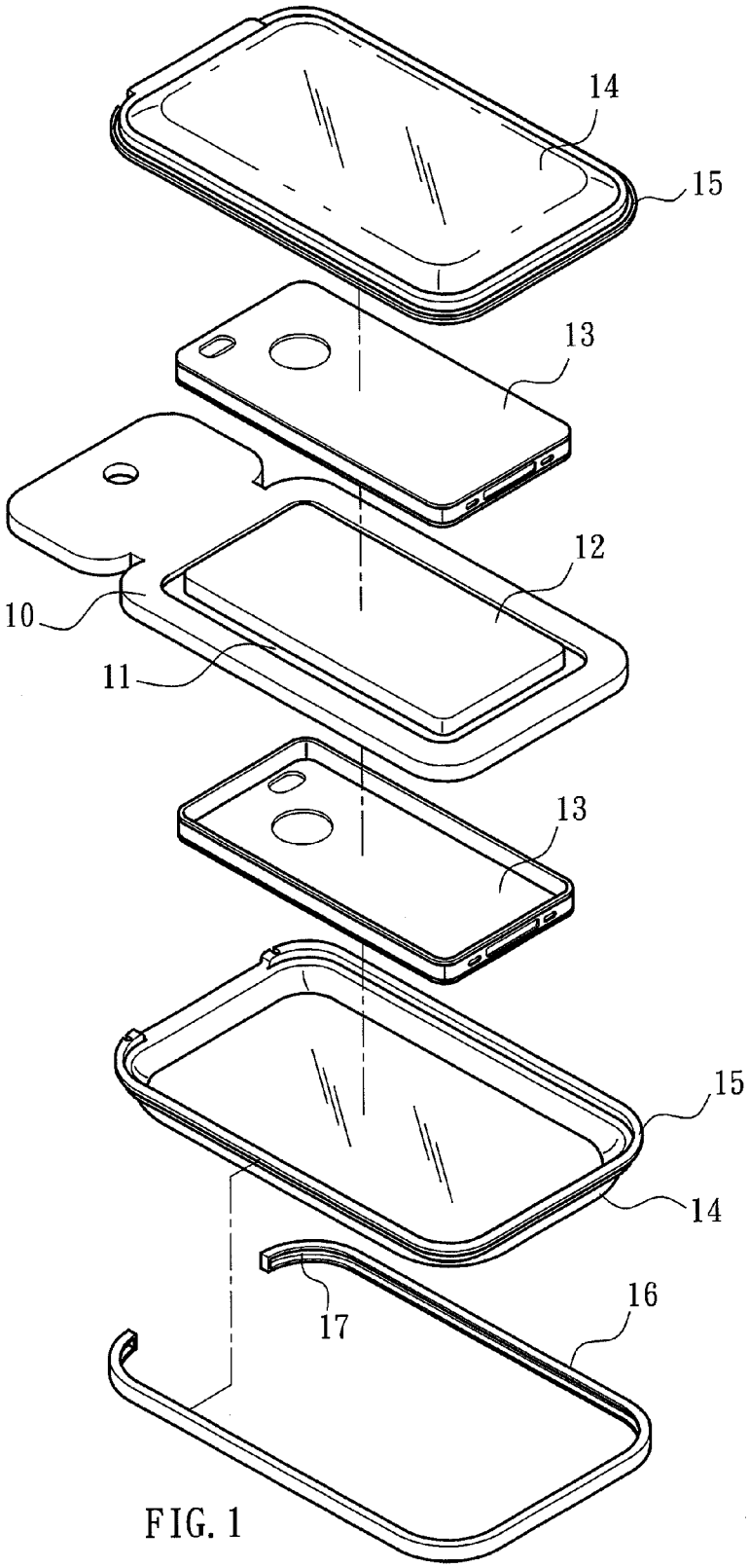
FIG. 1 is an exploded view according to a preferred embodiment of the present invention.
Figure 2:
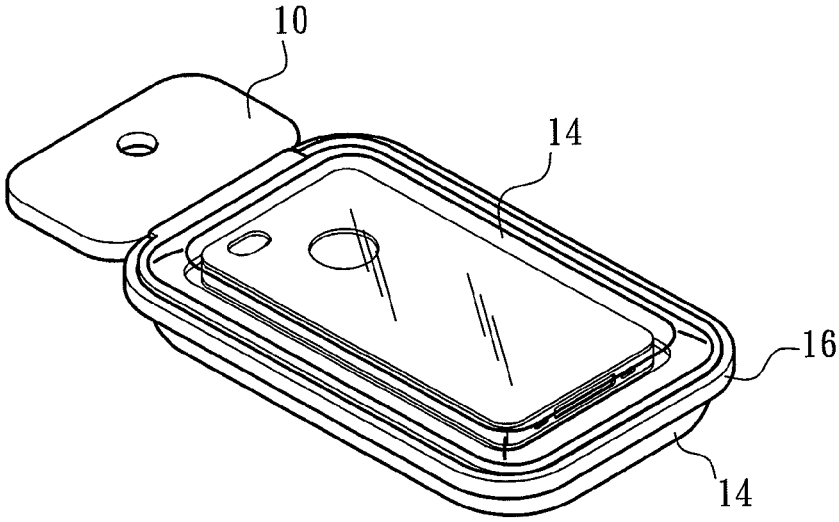
FIG. 2 is a perspective view according to the preferred embodiment of the present invention.
Figure 3:
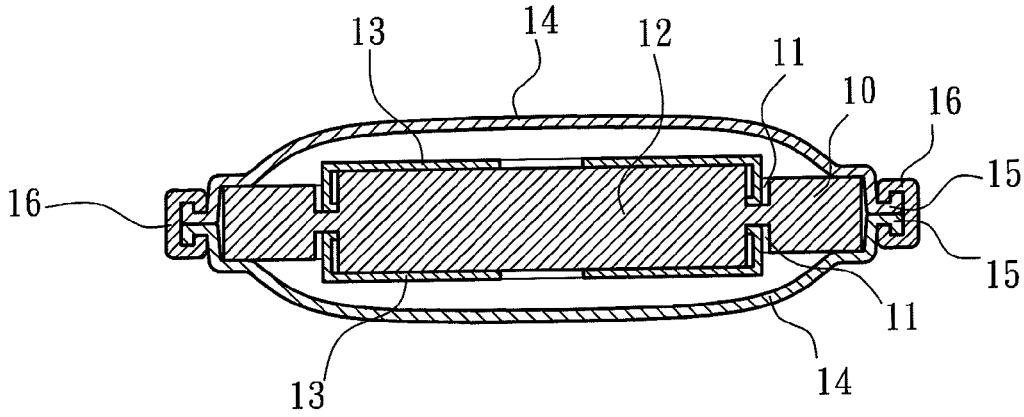
FIG. 3 is a sectional view according to the preferred embodiment of the present invention.

As shown in FIG. 1, FIG. 2 and FIG. 3, the packing box structure for a cell phone protection case according to a preferred embodiment of the present invention comprises a main body 10 in a plate shape, a pair of transparent lids 14 and a seal rib 16. The main body 10 has a pair of grooves 11 and a pair of positioning portions 12 at two sides thereof for engagement of a pair of cell phone protection cases 13. The pair of transparent lids 14 is adapted to cover the two sides of the main body 10. Each transparent lid 14 has a flange 15 around a peripheral portion thereof. The seal rib 16 has an engaging groove 17 therein. The engaging groove 17 is adapted to engage with the flanges 15 of the pair of transparent lids 14 and the seal rib 16 is to clip the pair of transparent lids 14, so that the transparent lids 14 and the main body 10 are assembled together.

Figure 4:
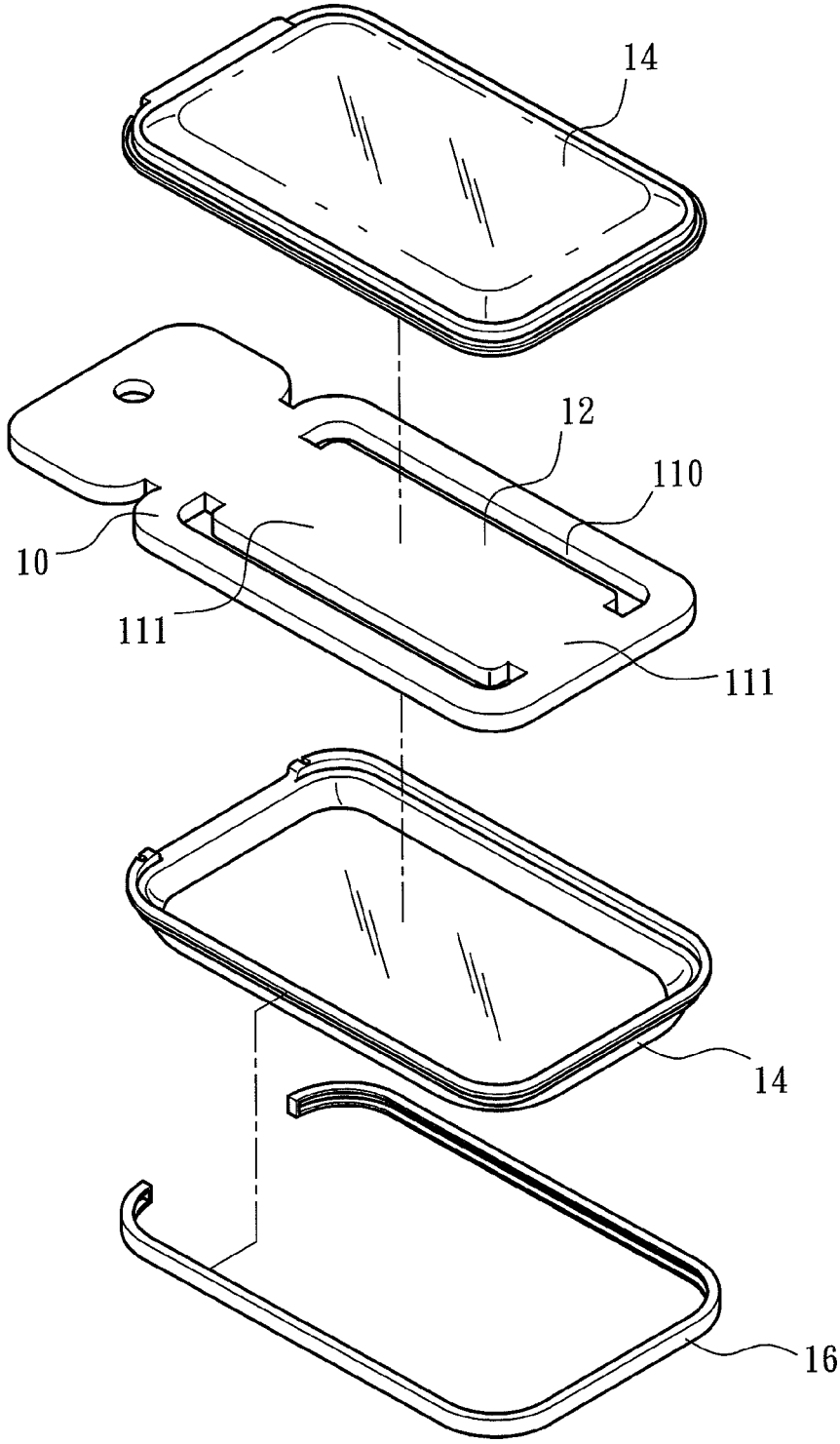
FIG. 4 is an exploded view according to another embodiment of the present invention.

FIG. 4 shows another embodiment of the main body 10 of the present invention. The main body 10 has through grooves 110 through the two sides of the main body 10, a positioning portion 12, and a pair of connection portions 111 at two ends of the positioning portion 12. The through grooves 110 and the positioning portion 12 are for engagement of the pair of cell phone protection cases.

The present invention has the following effects and advantages.

1. Both sides of the main body are adapted for placement of the cell phone protection cases 13 to provide a better display effect.

2. The two transparent lids 14 are sealed by the seal rib 16 to prevent dust from entering the cell phone protection case so that the cell phone protection case can be protected well.

3. The seal rib 16 is flexible for assembly and disassembly, such that the consumer can open the transparent lids 14 to check the cell phone protection case conveniently and quickly. There is no hole caused by the use of staples when the packing box is assembled again.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A packing box structure for a cell phone protection case, comprising a main body in a sheet shape, a pair of transparent lids and a seal rib, the main body having a pair of grooves and a pair of positioning portions at two sides thereof for engagement of a pair of cell phone protection cases, the pair of transparent lids being adapted to cover the two sides of the main body, each transparent lid having a flange around a peripheral portion thereof, the seal rib having an engaging groove therein, the engaging groove being adapted to engage with the flanges of the pair of transparent lids, the seal rib being adapted to clip the pair of transparent lids so that the transparent lids and the main body are assembled and secured.

2. The packing box structure for a cell phone protection case as claimed in claim 1, wherein the grooves of the main body are through grooves through the two sides of the main body.

* * * * *